United States Patent [19]

Matysek et al.

[11] Patent Number: 4,989,853

[45] Date of Patent: Feb. 5, 1991

[54] APPARATUS FOR OFFSETTING SHEETS

[75] Inventors: James F. Matysek, Fairport; Richard C. Schenk, Webster; Charles E. Smith, Pittsford, all of N.Y.

[73] Assignee: Xerox Corporation, Stamford, Conn.

[21] Appl. No.: 276,986

[22] Filed: Nov. 28, 1988

[51] Int. Cl.[5] ..... B65H 39/02

[52] U.S. Cl. ..... 270/58; 271/213; 414/791.2

[58] Field of Search ..... 270/37, 53, 58; 271/286, 213; 414/791.2

[56] References Cited

U.S. PATENT DOCUMENTS

| | | | |
|---|---|---|---|
| 4,236,856 | 12/1980 | Mol et al. | 414/54 |
| 4,293,214 | 10/1981 | George | 414/791.2 |
| 4,318,539 | 3/1982 | Lamos | 270/58 |
| 4,382,592 | 5/1983 | Harding | 270/53 |
| 4,712,786 | 12/1987 | Looney | 271/207 |
| 4,735,408 | 4/1988 | Yamashita | 271/213 |

FOREIGN PATENT DOCUMENTS

| | | | |
|---|---|---|---|
| 2732673 | 9/1978 | Fed. Rep. of Germany | 270/53 |
| 69-0295969 | 12/1986 | Japan | 414/791.2 |

OTHER PUBLICATIONS

Xerox Disclosure Journal, *Copy Set Collecting Apparatus*, John H. Looney, vol. 2, No. 4, Jul./Aug. 1977.

Xerox Disclosure Journal, Staggered Output Tray, T. R. Cross, vol. 5, No. 1, Jan./Feb. 1980.

*Primary Examiner*—Edward K. Look

*Assistant Examiner*—Therese M. Newholm

*Attorney, Agent, or Firm*—H. Fleischer; J. E. Beck; R. Zibelli

[57] ABSTRACT

An apparatus which delivers to an operator offset batches of sheets reproduced from at least one set of documents. The operator selects the number of sheets or sets of sheets successive batches to be offset from one another. In this way, the number of copy sheets in the batch may range from a partial set of copy sheets to multiple sets of copy sheet. Also, the operator may select no offset within a job providing a straight stack with no distinction between batches or sets.

20 Claims, 4 Drawing Sheets

APPARATUS FOR OFFSETTING SHEETS

This invention relates generally to an electrophotograhic printing machine, and more particularly concerns an apparatus for delivering to an operator offset batches of copy sheets reproduced from at least one set of original documents.

In a typical electrophotographic printing process, a photoconductive member is charged to a substantially uniform potential so as to sensitize the surface thereof. The charged portion of the photoconductive member is exposed to a light image of an original document being reproduced. Exposure to the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are collected into unfinished sets of copy sheets. The collected copy sheets may then be bound or stapled together into finished sets of copy sheets. Finished or unfinished sets of copy sheets are then stacked for presentation to the machine operator. Each set of copy sheets has the same number of sheets as the set of original documents being reproduced by the electrophotographic printing machine. The number of copy sheets in a batch of copy sheets may be less than, more than, or equal to the number of copy sheets or original documents in a set.

In a high speed commercial printing machine of the foregoing type, large volumes of finished or unfinished sets of copy sheets are fed onto a stacking tray. The copy sheets of each set have the edges of their edges aligned. In many applications, it is desirable to have the sets of copy offset from one another so that individual sets of copy sheets may be more easily identified. One type of electrophotographic printing machine that provides this feature is the Xerox Model No. 9900 which automatically offsets each partial or complete set of copy sheets unloaded from the sorter bins. In order to increase the flexibility of the printing machine in a centralized reproduction department, it is desirable to enable the operator to select the number of copy sheets in a batch wherein successive batches are offset from one another.

Various approaches have been devised for off setting successive sets copy sheets from one another. The following disclosures appear to be relevant:

US-A-4,236,856
Patentee: Mol et al.
Issued: Dec. 2,1980

US-A-4,318,539
Patentee: Lamos
Issued Mar. 9, 1982

US-A-4,712,786
Patentee: Looney
Issued: Dec. 15, 1987

The relevant portions of the foregoing patents may be summarized as follows:

US-A-4,236,856 discloses two modes of offsetting sets of copy sheets from one another. In one mode, the sets of copy sheets are alternately laterally offset from one another. In the other mode of offset, the sets of copy sheets are alternately skewed from one another.

US-A-4,318,539 describes an apparatus for offset collation. The first sheets of the set are stacked in an alternate offset fashion. The remaining successive sheets of the set are inserted in the same alternate offset fashion contiguous to the first sheet.

US-A-4,712,786 describes an off setting device located within a printer and being adapted to translate sheets in route to the sorter alternately front and rearward. In this way, the copy sheets are offset before they are driven into the sorter and successive sets of copy sheets are offset from one another.

In accordance with one aspect of the present invention, there is provided an apparatus for delivering to an operator offset batches of sheets reproduced from at least one set of documents. The apparatus includes means for selecting the number of sheets of each batch to be offset from one another. Means are provided for receiving and supporting the sheets. Means, responsive to the selecting means, move the receiving and supporting means at selected intervals to offset a selected number of sheets corresponding to a batch of sheets from one another. The selected number of sheets in the batch ranges from a number of sheets less than a complete set to a number of sheets greater than a complete set.

Pursuant to another aspect of the features of the present invention, there is provided an electrophotographic printing machine of the type in which copy sheets reproduced from at least one set of original documents are advanced to a finishing station for finishing and delivery of offset batches of copy sheets to the printing machine operator. The improvement includes means for selecting the number of copy sheets of each batch to be offset from one another. Means are provided for receiving and supporting the copy sheets. Means, responsive to the selecting means, move the receiving and supporting means at selected intervals to offset a selected number of copy sheets corresponding to a batch of copy sheets from one another. The selected number of copy sheets in the batch ranges from a number of copy sheets less than a complete set to a number of copy sheets greater than a complete set. Other aspects of the present invention will become apparent as the following description proceeds and upon reference to the drawings, in which:

Figure 2:
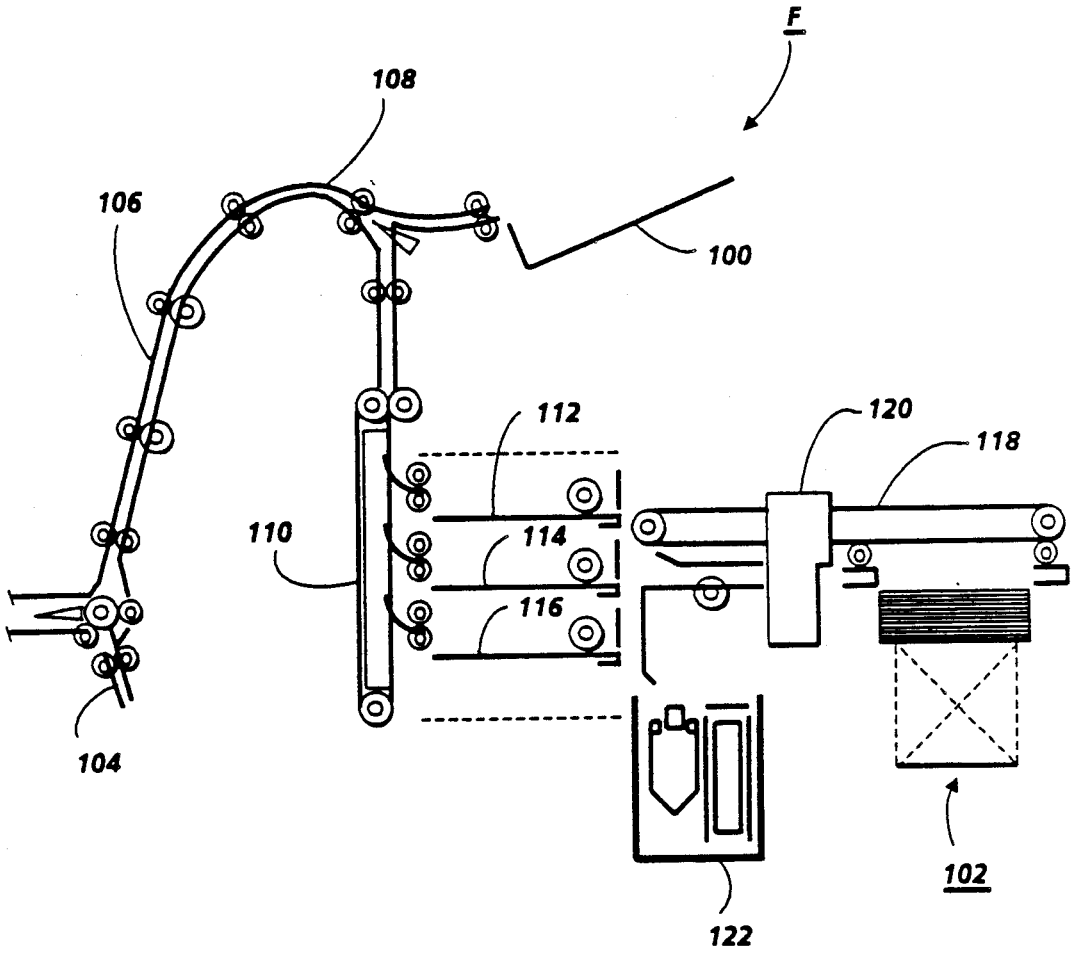
FIG. 2 is a schematic elevational view showing the finishing station of the FIG. 1 printing machine.
Figure 3:
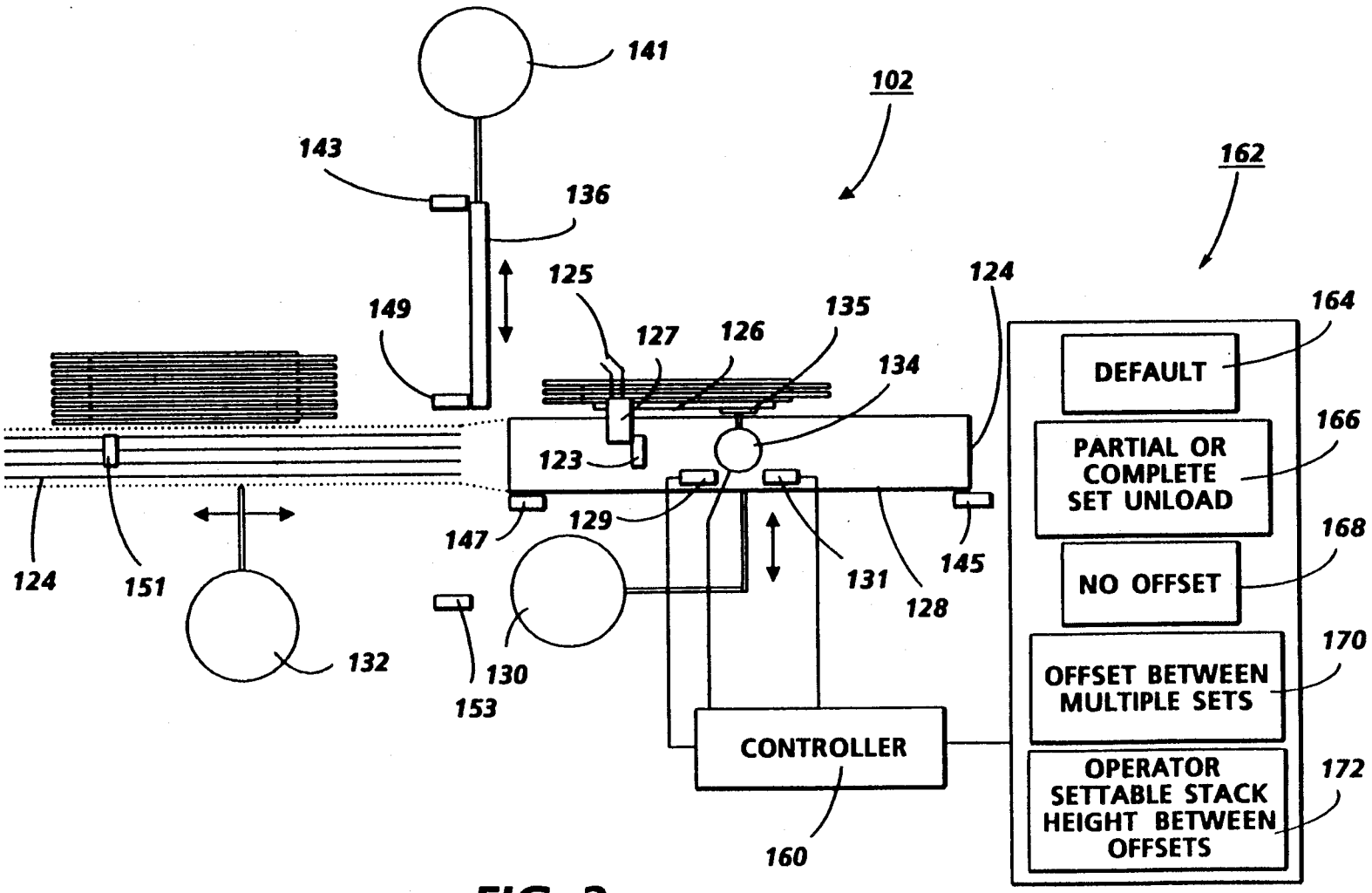
Figure 4:
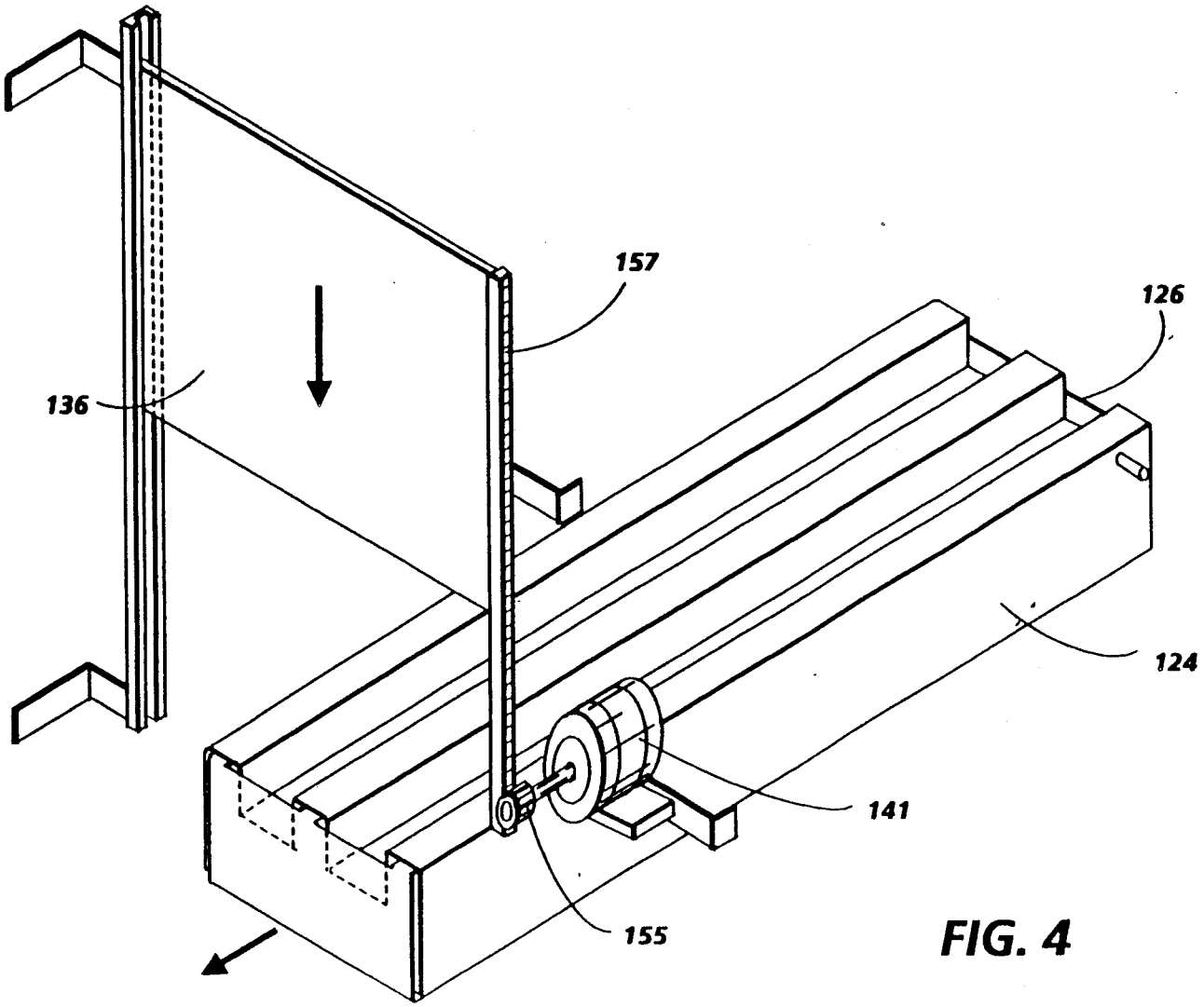

FIG. 3 is a schematic elevational view illustrating the batch offset delivery apparatus of the FIG. 2 finishing station; and FIG. 4 is a perspective view depicting a portion of the FIG. 3 delivery apparatus. While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
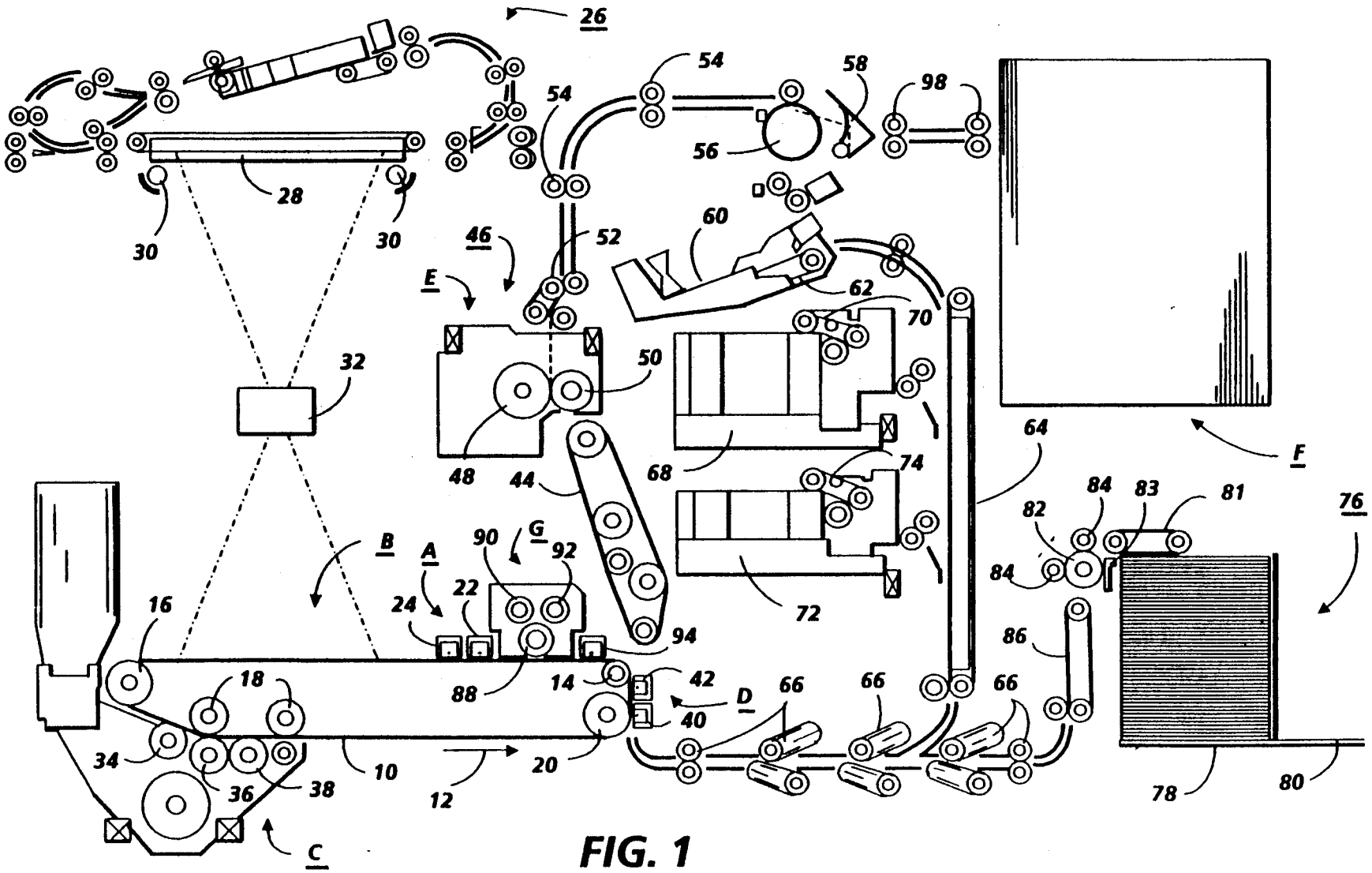
FIG. 1 is schematic elevational view depicting an illustrative electrophotographic printing machine incorporating a finisher having the batch offset delivery apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the batch offset delivery apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a set of documents placed by the operator face up in a normal forward collated order in the document stacking and holding tray. A document feeder located below the tray forwards the bottom document in the set to a pair of take-away rollers. The bottom sheet is then fed by the rollers through a document guide to a feed roll pair and belt. The belt advances the document to platen 28. After imaging, the original document is fed from platen 28 by the belt into a guide anD feed roll pair. The document then advances into an inverter mechanism and back to the top of the set of original documents through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sets of copy sheets may remain unfinished or may be finished by being attached to one another. The sheets of each set are attached to one another by either a binding device or stapling device. In either case, a plurality of finished or unfinished sets of copy sheets are formed in finishing station F. The sets of copy sheets are delivered to a stacker. In the stacker, each batch of copy sheets is offset from the next successive batch of copy sheets. The operator selects the number of copy sheets in a batch. The batch can correspond to a set of copy sheets, or be more than or less than a set of copy sheets. Further details of batch selection are shown in FIG. 3 and will be described hereinafter with reference thereto. The general operation of finishing station F will be described hereinafter with reference to FIG. 2.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 aND rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard utilizing a feed belt anD take-away rolls to advance successive copy sheets to transport 65 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller 160 (FIG. 3). The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected. Further details of the operation of controller 160 for defining the number of sheets of each offset batch of copy sheets in a job will be described hereinafter with reference to FIG. 3.

Referring now to FIG. 2, the general operation of finishing station F will now be described. Finishing station F receives fused copies from rolls (FIG. 1) and delivers them to the top tray 100 or to the batch offset delivery apparatus of the present invention, indicated generally by the reference numeral 102. The details of batch offset delivery apparatus 102 will be described hereinafter with reference to FIG. 3. Sets of copy sheets delivered to sheet delivery apparatus 102 may be either finished or unfinished. Unfinished sets, partial sets, or multiple sets may be make up a batch and be offset from one another. Similarly, a single finished set or multiple finished sets may make up a batch and be offset from one another. The finished sets are stapled with one or two staples, or have the spine thereof bound with an adhesive binding. The sheet path of finishing station F has an inverter 104 driven by a reversible AC motor. The inverter has a solenoid actuated diverter gate that diverts sheets into the inverter, and a tri-roll nip that is used to drive sheets into and out of the inverter. Registration transport 106 is used to transport sheets from inverter 104 to output transport 108. Two cross roll registration nips are used to register the sheets. The cross roll registration nips are driven by the sheet path drive motor. The output transport 108 is driven by the sheet path drive motor. It transports sheets from the registration transport to the top tray gate where the sheets are diverted to either vacuum transport 110 or into top tray 100. Vacuum transport 110 is used to transport sheets from transport 108 to any one of three bins 112, 114 or 116. Bins 112, 114, and 116 are used to compile and register sheets into sets. The bins are driven up or down by a bidirectional AC bin drive motor adapted to position the proper bin at the unloading position. A set transport 118 has a pair of set clamps mounted on two air cylinders and driven by four air valve solenoids. Two of the air valves are used for positioning the set transport and two are used for the retract function. The set transport is used to transport sets from the bins to the stitcher 120, binder 122 and batch offset delivery apparatus 102. The finished or unfinished sets are delivered to batch offset delivery apparatus 102 where they are stacked and offset in operator selected batches for delivery to the operator.

Turning now to FIG. 3, there is shown a schematic illustration of batch offset delivery apparatus 102. Apparatus 102 has a stack delivery drawer 124 and a stack offset tray 126 both of which are mounted on a platform elevator 128 that is driven by a bi-directional AC motor 130. The delivery drawer 124 is driven in and out of the printing machine by a bidirectional AC motor 132. During loading, motor 130 moves elevator 128 upwardly to position tray 126 and drawer 124 at the loading station. Tray 126 is raised so that the tray surface is slightly above the surface of drawer 124. The offset tray 126 is moved to its' two offset positions by a bidirectional AC motor 134 coupled to a surface cam 135. Cam 135 has a groove that a pin attached to the lower portion of tray 126 follows when motor 134 rotates cam 135. This groove translates the motor rotational movement into forward or reverse movement depending upon the direction that motor 134 is commanded to rotate. Guide pins in slots on the lower portion of tray 126 allow forward or reverse movement of the tray while maintaining the tray position on drawer 124. Switches 129 and 131 located on the top of the elevator at the front and rear of tray 126, when actuated, signal to controller 160 that the tray is in the forward or reverse position. The controller, in turn, signals to stop forward or reverse movement. In this way, while sets of copy sheets are being loaded onto the tray, the tray alternately offsets a selected batch of copy sheets about 24 millimeters, and the elevator motor indexes the tray and drawer downwardly to maintain proper stack height. A stack bale 125 mounted on the rear of the set transport carriage above tray 126 moves down after each set of copy sheets is loaded on tray 126 to press each newly loaded set of copy sheets down to yield maximum set capacity. An air valve and solenoid 127 move bale 125 using air pressure.

The number of copy sheets in each batch is controlled by the controller 160 of the printing machine. Successive batches of copy sheets are offset from one another. Depending upon the operator selection, the controller regulates offsetting successive batches of copy sheets after the selected number of copy sheets has been transported onto tray 126. A display, indicated generally by the reference numeral 162, has a plurality of operator actuatable regions, 164, 166, 168, 170, and 172. The display 162 may be a keyboard having keys 164, 166, 168, 170 and 172 thereon. Alternatively, display 162 may be a touch screen wherein discrete regions thereon display keys 164, 166, 168, 170 and 172 which are operator actuatable by the operator touching the screen in the region thereof. Depending upon the key that is selected, display transmits a signal to controller 160. In response thereto, controller 160 actuates motor 134 to rotate cam 135 so as to move tray 126 after the number of copy sheets corresponding to the selected batch size have been stacked thereon. Switches 129 and 131 transmit a signal to controller 160 indicating that the tray 126 has moved as required so as to offset successive batches of copy sheets from one another at the correct interval. If none of the keys are actuated, a default condition exists. Similarly, if key 164 is actuated by the operator, a default condition exists. When a default condition exists, the number of copy sheets in the batch is equal to the number of copy sheets in the set of copy sheets or original documents. Thus, in this mode of operation, successive sets of copy sheets are offset from one another. When key 166 is actuated, the batch of copy sheets corresponds to a portion of a set. Hence, when key 166 is actuated, the operator must next select the number of sheets to be included in the batch by continuing to actuate key 166 until the desired number of copy sheets is displayed on the copier display. In this mode, the batch corresponds to a partial set, i.e. a partial unfinished set. After this information is transmitted to controller 160, controller 160 energizes motor 134 at successive intervals after successive batches having the selected number of copy sheets therein have been stacked on tray 126. Once again, switches 129 and 131 transmit a signal to controller 160 verifying that tray 126 has offset the copy sheets at the selected interval. When key 168 is actuated, controller 160 deenergizes motor 134 and all of the sheets stacked on tray 126 are aligned with one another. Thus, when key 168 is selected by the operator, there is no offset and the stack of sheets on tray 126 are straight, i.e. in-line. Actuation of key 170 by the operator defines the batch as containing a plurality of sets of copy sheets. Thus, after the operator actuates key 170, the operator must next select the number of sets to be included in the batch by continuing to actuate key 170 until the desired number of sets is displayed on the copier display. After the number of sets in the batch have been defined, display 162 transmits a signal to controller 160 corresponding thereto. In response to the signal from display 162, controller 160 will actuate motor 134 after the number of sets corresponding to the selected number of sets in the batch has been stacked on tray 126, controller 160 energizes motor 134 which rotates cam 135 to move tray 126 forward so as to offset the batch on tray 126 from the next successive batch of sets of copy sheets being stacked thereon. Finally, actuation on key 172 by the operator defines the batch as having an operator selectable number of copy sheets therein with the number of copy sheets in the batch being greater than the number of copy sheets in the set. Thus, after energization of key 172, the operator must continue to actuate key 172 until the desired number of copy sheets in the batch is displayed on the copier display. After the desired number of copy sheets for the batch have been selected by the operator, controller 160 energizes motor 134 to move tray 126 so as to offset the batch from the next successive batch stacked thereon. Switches 129 and 131 transmit a signal to controller 160 confirming that tray 126 has moved to the forward or reverse position so as to offset the batch of copy sheets. After the job is completed and the batches of copy sheets have been stacked on tray 126 in accordance with the mode selected by the operator, the stacked, offset batches of copy sheets are delivered to the operator.

Before being delivered to the unload station for removal from the finishing station, the stack of batches of copy sheets on tray 126 are delivered to the discharge station. At the discharge station, tray 126 is lowered so that the upper tray surface is below the upper drawer surface. The up and down movement of tray 126 is controlled by cam 135. Cam 135 produces the up and down movement when motor 134 rotates. Rollers, attached to the tray, ride on the lobes of the cam. The high points of the lobes lift the tray and the low points lower the tray allowing up and down movement of the tray while maintaining tray position. The cam lobes and the grooves are placed in such a manner that the up and down movement and the forward and reverse movement occur at difference are segments of the rotation of motor 134. As the cam rotates 75° counter clockwise, the tray moves forward. As the cam rotates clockwise 75° tray 126 reverses and returns. As the cam rotates counter clockwise 45° (from the initial 75°), the upper surface of tray 126 drops lower than the upper surface of drawer 124 transferring the stack of batches of copy sheets from the tray of the drawer. This occurs at the discharge station, where the batches of copy sheets are transferred from the tray to the drawer for delivery of copy sheets are transferred from the tray to the drawer for delivery to an intermediate station. During the delivery cycle, the stack delivery drawer is driven out of the machine to an intermediate station, and as soon as the drawer is at the intermediate station external of the finishing station, the drawer and stacker tray are moved upwardly to return the tray to the loading station, and to position the drawer at a convenient location for operator access, about 74 centimeters above the floor, for easier unloading of the batches of copy sheets therefrom at the unloading station. This action positions the tray at the loading station where it is ready to receive additional copy sheets and also positions the drawer with the stack of batches of copy sheets thereon at the unloading station. A safety door 136, driven by a bi-directional AC motor 141, opens to permit the stack delivery drawer 124 to move from the discharge station to the intermediate station and then to the unloading station. FIG. 3 shows stack delivery drawer 124 to the left when it is at the intermediate station and to the right when it is located at the discharge station where the stack of batches of copy sheets is being transferred from tray 126 to drawer 124. Door 136 is closed when drawer 124 is in the machine during delivery of batches of copy sheets to tray 126 when it is in the loading station. After the batches of sheets have been transferred to the delivery drawer at the discharge station, the door is driven up to allow the delivery drawer to deliver the stack of batches of copy sheets to the unloading station where the operator may remove the stack.

In operation, controller 160 regulates motor 130 to move elevator 128 having tray 126 and drawer 124 mounted thereon to its uppermost position at the loading station. At the loading station, sets of finished or unfinished sheets are advanced onto tray 126. A stack height sensor 123 comprising two sections placed at the front and rear of tray 126, above the tray. Each section has a light emitting diode and a photodetector. Each light emitting diode directs a light beam across the top of the tray so that if either light beam is blocked, the photodetector signals that a set of copy sheets is blocking the array. Between loading successive sets of copy sheets, the controller interrogates the sensor array state. If the sensor array state indicates a light beam is blocked by the stack, then the controller signals to motor 130 to turn on and drive elevator 124 down moving tray 126 down until the sensor array state changes to signal that the stack of coy sheets is clear of both light beams. The process continues so as to maintain the uppermost sheet on the tray at a fixed position for receiving successive sets. Motor 130 is located on the base of the finisher station frame towards the rear of the sheet stacker area. Motor 130 supplies rotational drive, via a drive belt and pulleys, to the lower end of two vertical lead screw. The lead screw passes through a nut affixed to the side of the elevator to move the elevator up or down. A stack hold position switch, located near the bottom elevator path of movement, is actuated when the elevator moves down. At this point, the controller is programmed, based on an internal program using look-up tables which consider such things as; set sheet count, sheet length, stitch or bind option selected, etc, to calculate the remaining number of sets or copy sheets be placed on the tray prior to offsetting. In addition, the controller determines the required number of sets of copy sheets to be placed on the tray to complete the selected job. When the calculated batch size is reached, the tray is moved to offset the next successive batch from the batch presently on the tray. When the calculated set quantity corresponding to tray capacity or job completion is reached, a delivery cycle is initiated to deliver the completed stack of batches to the operator. At this time, motor 141 is energized to rotate a drive screw which moves door 136 upwardly. When door 136 is fully up, switch 143 is actuated. Switch 143 signals the controller that the path is now clear for drawer 124 to deliver the sets of copy sheets from the discharge station to the unloading station.

Tray 124 is made from several horizontal struts equally spaced from one another and defining a horizontal surface for supporting the sets of sheets of the stack. Drawer 126 is made from three horizontal struts equally spaced from one another and defining a horizontal stack support surface. The drawer struts extend along the tray spaces and the tray struts extend along the drawer spaces so that tray struts pass through the drawer spaces, i.e. tray struts are positioned within grooved cutouts in the drawer. As the tray struts lower, the upper surface of the tray struts descends beneath the upper surface of the drawer struts to transfer the stack of sets of sheets from the tray to the drawer. This occurs at the discharge station. A switch 131 located on elevator 124 is actuated when the tray is in the lowered position. When actuated, this switch signals to the controller that tray 126 is in the down position and switch 143 indicates that door 136 is in the up position. With door 136 in the up position, drawer 124 can pass through the opening with the stack of sets of sheets thereon. The controller, in turn, actuates motor 132 to move drawer 124 horizontally from the discharge station to the intermediate station. When drawer 124 with the stack of sets of sheets thereon is at the intermediate station, switch 145 is opened and switch 147 is closed. Motor 130 is now energized to move the elevator 128 upwardly to position tray 126 at the loading station and drawer 124 at the unloading station. Motor 141 is now energized to move door 136 downwardly to the top of drawer 124. Switch 149 is now energized indicating that the door is at the top of the drawer. The operator now removes the batches of copy sheets from drawer 124. After the batches of copy sheets have been removed from drawer 124, switch 151 is actuated signaling the controller that the stack of batches of copy sheets have been removed. The controller than energizes motor 132 to move drawer 124 back to the loading station internal of the finishing station. This closes switch 145 and opened and switch 145 being closed, actuates motor 141 to move door 136 downwardly to the fully closed position actuating switch 153 and completing the cycle.

Elevator 128 includes two struts, one strut is on each side. The struts support drawer 124 horizontally and are mounted vertically slidable in the elevator frame. The ends of the struts are mounted on two drive screws connected by a drive belt and pulleys to motor 130. As motor 130 rotates in one direction, the elevator moves from the discharge station to the loading station. When motor 130 reverses direction, the elevator moves from the loading station to the discharge station. Drawer 124 is mounted on slides on elevator 128. Motor 132 is mounted on motor 132 anD a pulley mounted on elevator. The belt is clamped to the drawer. As the motor rotates, the belt translates the drawer from the discharge station to the intermediate station and from the unloading station to the loading station. Switch 147 is mounted under the drawer toward the front. The switch is actuated by a protruding ramp at the bottom rear of the drawer when the drawer if fully out at the intermediate station and the unloading station. The switch than signals the controller and the drive is stopped. Switch 145 is mounted under the drawer toward the rear. The switch is actuated by a ramp which is at the bottom front of the drawer. When the drawer is fully in, at the discharge station and loading station, switch 145 signals the controller and the drive is stopped. Sensor 151 is located under the surface of the drawer. When copy sheets are laying on the drawer over the sensor, light from the sensor light emitting diode is reflected back to the sensor. At the completion of the drawer drive out cycle, the controller monitors the sensor state. When the operator removes the sets of copy sheets, the sensor no longer receives reflected light from the light emitting diode. The sensor state changes and the controller signals to drive the drawer from the intermediate station to the loading station.

FIG. 4 shows the operation of the door 136. Door 136 is mounted vertically slidably in the cover of the finishing station of the printing machine. Both the loading station and the discharge station are located internally of the finishing station of the printing machine. The intermediate station and the unloading station are positioned externally of the finishing station of the printing machine. The upper surface of tray 126 has descended below the upper surface of drawer 124. Motor 141 is energized to rotate gear 155. Gear 155 meshes with rack 157. Rack 157 is mounted on door 136. As motor 141 rotates gear 155, rack 157 translates upwardly or downwardly moving door 136 therewith. In this way, door 136 opens enabling the sets of copy sheets transferred from tray 126 to drawer 124 to move therewith from the discharge station to the intermediate station, and then to the unloading station where the operator removes the sets of copy sheets therefrom.

In recapitulation, the apparatus of the present invention permits the operator to define the number of copy sheets or sets of copy sheets in successive batches which are offset from one another. The number of copy sheets in the batch ranges from a partial set of copy sheets to multiple sets of copy sheet. The operator may also select no offset within a job providing a straight stack with no distinction between batches or sets.

It is therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for delivering to an operator offset batches of sheets reproduced from at least one set of documents, including:

means for selecting the number of sheets of each batch to be offset from one another;

means for receiving and supporting the sheets; and means, responsive to said selecting means, for moving said receiving and supporting means at selected intervals to offset from one another a selected number of sheets corresponding to a batch of sheets with the selected number of sheets in the batch ranging from a number of sheets less than a complete set to a number of sheets greater than a complete set.

2. An apparatus for delivering to an operator offset batches of sheets reproduced from at least one set of documents, including:

means for selecting the number of sheets of each batch to be offset from one another comprises means for controlling said moving means, and a display having a plurality of operator actuatable regions thereon with each region defining the number of sheets of each batch offset from one another;

means for receiving and supporting the sheets; and means, responsive to said selecting means, for moving said receiving and supporting means at selected intervals to offset from one another a selected number of sheets corresponding to a batch of sheets with the selected number of sheets in the batch ranging from a number of sheets less than a complete set to a number of sheets greater than a complete set.

3. An apparatus according to claim 2, wherein said receiving and supporting means includes a tray.

4. An apparatus according to claim 3, wherein said moving means includes motor coupled to said tray and regulated by said controller to move at an interval corresponding to the selected number of sheets so as to offset successive batches of sheets from one another.

5. An apparatus for delivering to an operator offset batches of sheets reproduced from at least one set of documents, including:

means for selecting the number of sheets of each batch to be offset from one another said selecting means comprises means for controlling said moving means, and a display having a plurality of operator actuatable regions thereon with each region defining the number of sheets of each batch offset from one another;

means for receiving and supporting the sheets, said receiving and supporting means comprises a tray; and means, responsive to said selecting means, for moving said receiving and supporting means at selected intervals to offset from one another a selected number of sheets corresponding to a batch of sheets with the selected number of sheets in the batch ranging from a number of sheets less than a complete set to a number of sheets greater than a complete set, said moving means comprises a motor coupled to said tray and regulated by said controller to move at an interval corresponding to the selected number of sheets so as to offset successive batches of sheets from one another, said moving means includes means for detecting that said tray is in an offset position and in a non-offset position, said detecting means being connected to said controller which regulates said motor in response thereto.

6. An apparatus according to claim 5, wherein one of the plurality of actuatable regions of said display defines the number of sheets of each batch as being equal to the number of documents of one set.

7. An apparatus according to claim 5, wherein one of the plurality of actuatable regions of said display defines the number of sheets of each batch as being less than number of documents of one set.

8. An apparatus according to claim 5, wherein one of the plurality of actuatable regions of said display defines the number of sheets of each batch as being greater than number of documents of one set.

9. An apparatus according to claim 5, wherein one of the plurality of actuatable regions of said display defines the number of sheets of each batch as being equal the number of documents of a plurality of sets.

10. An apparatus according to claim 5, wherein one of the plurality of actuatable regions of said display defines a non-offset condition wherein all of the sheets supported on said tray are substantially aligned with one another without being offset.

11. An electrophotographic printing machine of the type in which copy sheets reproduced from at least one set of original documents are advanced to a finishing station for finishing and delivery of offset batches of copy sheets to the printing machine operator, wherein the improvement includes:

means for selecting the number of copy sheets of each batch to be offset from one another;

means for receiving and supporting the copy sheets; and means, responsive to said selecting means, for moving said receiving an supporting means at selected intervals to offset from one another a selector number of copy sheets corresponding to a batch of copy sheets with the selected number of copy sheets in the batch ranging from a number of copy sheets less than a complete set to a number of copy sheets greater than a complete set.

12. An electrophotographic printing machine of the type in which copy sheets reproduced from at least one set of original documents are advanced to a finished station for finishing and delivery of offset batches of copy sheets to the printing machine operator, wherein the improvement includes:

means for selecting the number of copy sheets of each batch to be offset from one another said selecting means comprises means for controlling said moving mean' and a display having a plurality of operator actuatable regions thereon with each region defining the number of copy sheets of each batch offset from one another;

means for receiving and supporting the copy sheets; and means, responsive to said selecting means, for moving said receiving an supporting means at selected intervals to offset from one another a selected number of copy sheets corresponding to a batch of copy sheets with the selected number of copy sheets in the batch ranging from a number of copy sheets less than a complete set to a number of copy sheets greater than a complete set.

13. A printing machine according to claim 12, wherein said receiving and supporting means includes a tray.

14. A printing machine according to claim 13, wherein said moving means includes motor coupled to said tray and regulated by said controller to move at an interval corresponding to the selected number of copy sheets so as to offset successive batches of copy sheets from one another.

15. An electrophotographic printing machine of the type in which copy sheets reproduced from at least one set of original documents are advanced to a finishing station for finishing and delivery of offset batches of copy sheets to the printing machine operator, wherein the improvement includes:

means for selecting the number of copy sheets of each batch to be offset from one another said selecting means comprises means for controlling said moving means, and a display having a plurality of operator actuatable regions thereon with each region defining the number of copy sheets of each batch offset from one another;

means for receiving and supporting the copy sheets, said receiving and supporting means comprises a tray; and means, responsive to said selecting means, for moving said receiving and supporting means at selected intervals to offset from one another a selected number of copy sheets corresponding to a batch of copy sheets with the selected number of copy sheets in the batch ranging from a number of copy sheets less than a complete set to a number of copy sheets greater than a complete set, said moving means comprises a motor coupled to said tray and regulated by said controller to move at an interval corresponding to the selected number of copy sheets so as to offset successive batches of copy sheets from one another, said moving means includes means for detecting that said tray is in an offset position and in a non-offset position, said detecting means being connected to said controller which regulates said motor in response thereto.

16. A printing machine according to claim 15, wherein one of the plurality of actuatable regions of said display defines the number of copy sheets of each batch as being equal to the number of original documents of one set.

17. A printing machine according to claim 15, wherein one of the plurality of actuatable regions of said display defines the number of copy sheets of each batch as being less than number of original documents of one set.

18. A printing machine according to claim 15, wherein one of the plurality of actuatable regions of said display defines the number of copy sheets of each batch as being greater than number of original documents of one set.

19. A printing machine according to claim 15, wherein one of the plurality of actuatable regions of said display defines the number of copy sheets of each batch as being equal the number of original documents of a plurality of sets.

20. A printing machine according to claim 15, wherein one of the plurality of actuatable regions of said display defines a non-offset condition wherein all of the copy sheets supported on said tray are substantially aligned with one another without being offset.

* * * * *